US005103981A

United States Patent [19]

Abbott et al.

[11] Patent Number: 5,103,981

[45] Date of Patent: Apr. 14, 1992

[54] PARTICLE SEPARATOR/CLASSIFICATION MECHANISM

[75] Inventors: Kenneth E. Abbott; Patrick J. Lyons, both of Tucson, Ariz.

[73] Assignee: Stripping Technologies Inc., Tucson, Ariz.

[21] Appl. No.: 645,229

[22] Filed: Jan. 24, 1991

Related U.S. Application Data

[63] Continuation of Ser. No. 316,338, Feb. 27, 1989, abandoned.

[51] Int. Cl.[5] ..... B07B 9/00; B07B 4/02

[52] U.S. Cl. ..... 209/37; 209/139.1; 209/149; 406/153

[58] Field of Search ..... 209/30, 31, 36, 37, 209/138, 139.1, 133, 146, 149, 154, 44.1; 406/153, 141

[56] References Cited

U.S. PATENT DOCUMENTS

| | | | |
|---|---|---|---|
| 409,258 | 8/1889 | Ward | 209/139.1 X |
| 969,157 | 9/1910 | Day | 209/138 |
| 1,272,311 | 7/1919 | Plaisted | 209/139.1 |
| 2,931,500 | 4/1960 | Andrén et al. | 209/138 X |
| 3,421,618 | 1/1969 | Burney et al. | 209/696 X |
| 3,441,131 | 4/1969 | Gebauer | 209/139.1 X |
| 4,299,694 | 11/1981 | Goodell | 209/139.1 |
| 4,411,388 | 10/1983 | Muck | 406/153 X |
| 4,743,363 | 5/1988 | Darrow | 209/138 |
| 4,784,755 | 11/1988 | Taylor | 209/136 |
| 4,851,110 | 7/1989 | Rolle et al. | 209/135 |
| 4,933,072 | 6/1990 | Beisel | 209/135 X |

FOREIGN PATENT DOCUMENTS

| | | | |
|---|---|---|---|
| 198945 | 10/1986 | European Pat. Off. | 209/138 |
| 453358 | 12/1927 | Fed. Rep. of Germany | 209/138 |
| 2307589 | 12/1976 | France | 209/139.1 |

*Primary Examiner*—Donald T. Hajec
*Attorney, Agent, or Firm*—Mark E. Ogram

[57] ABSTRACT

A particle separator which separates particles based upon their relative densities or weights. The mixture of particles is deposited within a gas channel while a flow of gas, created by a gas flow amplifier, separates the material. The gas flow is sufficient to entrain the lighter/less dense particles; but is insufficient to entrain the heavier particles which are allowed to fall into a receptacle. The lighter entrained particles are directed to another receptacle or container.

20 Claims, 4 Drawing Sheets

PARTICLE SEPARATOR/CLASSIFICATION MECHANISM

BACKGROUND

This is a continuation of U.S. Patent application Ser. No. 07/316,338, filed Feb. 27, 1989 and entitled "A Particle Separation/Classification Mechanism" now abandoned.

This invention relates generally to particle separation and, more particularly, to particle separation based upon the relative densities or weights of the particles involved.

The separation of a useful product from an unusable item has plagued man almost from the dawn of time. In fact, the early form of threshing wheat, using the wind to blow away the chaff, is one such solution to the problem.

As the industrialization of the world took place, the separation of particles became a more intense problem since the materials sought were needed in higher concentrations than before.

Separating a fluid mixture has posed some very unique problems. With these problems, some unique solutions have been developed such as U.S. Pat. No. 4,539,103, entitled "Hydraulic Separating Method and Apparatus" issued Sept. 3, 1985, to Hollingworth; and U.S. Pat. No. 4,176,749, entitled "Materials Separation" issued Dec. 4, 1979, to Wallace et al. In both of these inventions, the material that is to be separated is suspended in a liquid which is utilized for the extraction of the material.

Unfortunately, the abilities and expertise of liquid seperators are not easily ported over to a mixture of dry material.

In attempting to solve this problem, a wide variety of fluidized beds have been developed including: U.S. Pat. No. 4,194,971, entitled "Method of Sorting Fluidized Particulate Material and Apparatus Therefor" issued Mar. 25, 1980, to Beeckmans; and U.S. Pat. No. 4,546,552, entitled "Fluid Induced Transverse Flow Magnetically Stabilized Fluidized Bed" issued Oct. 15, 1985, to Cahn et al.

In all fluidized bed separation situations, the mixture to be separated is suspended on a grate or bed while air "bubbles" through the mixture at a rate sufficient to remove a targeted particle permitting the remaining material to be swept away or to fall through the grate. Balancing the inflow of contaminated mixture to the throughput is extremely difficult. Without this control though, the mechanism does not perform optimally.

The problem of control is of such a concern that a whole group of inventions address this problem alone. One such invention is described in U.S. Pat. No. 4,248,702, entitled "Stratifier Discharge Control" issued Feb. 3, 1981, to Wallace et al.

Even though the fluidized bed concept is complex, it is far from optimal and a wide range of enhancements have been developed such as U.S. Pat. No. 4,156,644, entitled "Pulsating Sludge Bed with Inclined Plates" issued May 29, 1979, to Richard.

As the complexity of the devices have grown, so too has the down time and repair costs. To attempt to simplify the situation, some devices have attempted to revert to the simpler modes of operation, or have attempted to solve the problem in unique ways. This includes U.S. Pat. No. 4,589,981, entitled "Fluidized Bed Classifier" issued May 20, 1986, to Barari et al. and U.S. Pat. No. 4,521,303, entitled "Solids Separation in Self-Circulating Magnetically Stabilized Fluidized Bed" issued June 4, 1985, to Hicks et al.

In all of these apparatuses, the mechanism becomes more and more expensive to operate and acquire. This makes them less than ideal for many situations.

Perhaps the most illustrative of the techniques currently used are the ones developed to separate tobacco leaves and parts from sand. These include: U.S. Pat. No. 4,216,080, entitled "Method and Apparatus for Separating Sand from Botanical Fines" issued Aug. 5, 1980, to Summers et al.; U.S. Pat. No. Re 29,625, entitled "Process and Apparatus for Separating Sand from Botanical Materials" issued May 9, 1978, to Summers; and, U.S. Pat. No. 3,842,978 entitled "Process and Apparatus for Separating Sand from Botanical Materials" issued Oct. 22, 1974, to Summers.

In these inventions, the contaminated mixture (tobacco fines and sand) is dropped into a fluidized bed arrangement where it is supported by a grate. Air is drawn through the grate which causes the contaminated mixture to "bubble." The heavier sand falls through the grate. The bubbling action pulls a partially cleaned mixture of sand and fines up to a cyclone separator which performs a final cleaning of the mixture.

The final cleaning by the cyclone separator is necessary since it is this cyclone separator which provides the air draft to "suck" the partially cleaned mixture from the fluidized bed.

In these inventions, the use of the fluidized bed is required since the contaminated mixture must have a certain amount of dwell time within the separating mechanism. The dwell time within the bed is necessitated by the very nature of the cyclone separator which is extremely sensitive to many factors including the feed and exhaust tubing arrangement, physical damage to the input and exhaust ports, motor speed, variations in power source, etc.

It is clear from the foregoing that except for the expensive and delicate fluidized bed arrangements, an efficient inexpensive solution to the separation of particles does not exist.

SUMMARY OF THE INVENTION

The present invention deals with separating particles based upon their relative densities. For purposes of discussion herein, the separation of plastic media (i.e. thermoset or thermoplastic particles) from contaminants such as sand, paint particles, metal flakes, etc will be used. The invention is not so limited and those of ordinary skill in the art readily recognize other such applications, including but not limited to tobacco fine/-sand separation, mineral (e.g. gold dust) extraction, the removal of dust/fines from usable materials and hazardous materials removal.

Additionally, within this discussion, the separation of materials in a "dry" environment using air will be used. The invention is not so limited and it is readily apparent to those of ordinary skill in the art that this invention can as readily separate liquid mixtures having different densities and may use selected gases instead of "air."

Additionally, although the present discussion refers to the use of "air," those of ordinary skill in the art readily recognize that other gases, such as helium, can be used.

In the present invention, the mixed particles are deposited into a substantially vertical air channel, such as pipe. An air flow is established in the air channel using an air flow amplifier. This air flow is sufficient to entrain the lighter density material, but is insufficient to entrain the heavier density materials which are allowed to fall into a receptacle. The entrained lighter density material is conveyed to another receptacle or container.

As example, in the case of a mixture of plastic media and contaminants, the plastic media has a much lower density than the typical contaminants of sand, metal flakes, and even paint particles. When the present invention is utilized to separate the particles, the contaminants of sand, metal flakes, and paint particles fall into a container while the plastic media conveyed into another container for future use. The separated contaminants can then be easily disposed.

One important aspect of the present invention is its creation of the separating air flow. The invention utilizes an air flow amplifier. Some such air flow amplifiers are well known in the art. Some examples are: U.S. Pat. No. 4,046,492, entitled "Air Flow Amplifier" issued Sept. 6, 1977, to Inglis; U.S. Pat. No. 4,385,728, entitled "Flow-Amplifying Nozzle" issued May 3, 1983, to Inglis et al.; and U.S. Pat. No. 4,195,780, entitled "Flow Amplifying Nozzle" issued Apr. 1, 1980, to Inglis (all of which are incorporated hereinto by reference). Commercially, air amplifiers of relatively high amplification ratio are available from Vortec Corporation and are referred to as "transvectors".

The key to an air flow amplifier is that it utilizes air pressure under high pressure. This high pressure air is directed through an air channel. As the high pressure air flows, it naturally sucks or draws the heretofor static or ambient air along.

Because the resulting air flow is established by use of a relatively small amount of high pressure air, an air compressor can easily establish a source of high pressure air that is relatively constant. This assures that the air flow within the air channel does not either drop the lighter density particles nor does it entrain and carry the heavier density particles.

In this regard, it has been determined that the separation of plastic media having the following sizes can be separated using a five inch transvector from Vortec Corporation operating on a five inch pipe:

20 mesh 18 psi;
30 mesh 16 psi;
40 mesh 14 psi.

The contaminated mixture is deposited into the air channel through the use of slots around the circumferance of the air channel. In the preferred embodiment of the invention, these slots permit the contaminated mixture to fall along the walls of the air channel in a sheeting action to permit the air flow to efficiently separate the particles. The slots can be either fixed in size or may be adjustable depending upon the application and the mixture of interest.

In the preferred embodiment, to encourage the contaminated mixture to readily fall via the dropping mechanism, a vibrator is attached to the mechanism to prevent "lodging" of the mixture and to assure a flow. Those of ordinary skill in the art readily recognize other mechanisms which will accomplish this function.

Another important aspect of the present invention is the prefered embodiment's use of a final washing apparatus. The final washing apparatus is a ring or other deflection device to force the falling mixture away from the walls of the air channel and into the main flow.

In certain applications, the use of a final washing apparatus is extrememly beneficial. It has been found that due to the boundary layer affect, the airflow next to the air channel is much slower than that in the middle of the air channel. The slower airflow is insufficient to entrain the targetted material and as such it permits the contaminated mixture to fall unwashed. The deflection for a final wash, pushes the contaminated mixture towards the center of the air channel where the airflow will wash and entrain the ligher particles and permit the heavier particles to continue to fall.

In the preferred embodiment of the invention, the contaminated mixture is first separated into different sizes. Each sized group or mixture is then deposited into a separator of the present invention which has been preset to remove that size plastic media from the contaminant. As noted above, the removal of plastic media having a Size in the 20–30 mesh range requires an air pressure of 16–18 psi in the above described seperator.

In the preferred embodiment, the separation of the contaminated mixture into sized groups is accomplished through the use of a shaker or vibrator screen assembly with varying sizes of screens. The contaminated mixture is deposited into the top screen having the largest. The partially sized material falls through a series of shaking screens which successively separate the largest to the smallest particles. These particles include both the targeted plastic media as well as the contamination.

The sizing of the contaminated mixture is accomplished readily using a shaker screen such as that described by U.S. Pat. No. 3,539,008, entitled "Screening Apparatus Employing Rotating Cylindrical Screen and Stationary Feed Means" issued Nov. 10, 1970, to McKibben, incorporated hereinto by reference. Those of ordinary skill in the art readily recognize other such mechanisms which will operate in this environment.

The contaminant from each sized group falls through to a collection bin or container to be disposed. The cleansed plastic media is directed, using the existing air flow, into a container for later use.

In the preferred embodiment, the cleansed plastic media is remixed. Other applications for the cleansed particles require the maintenance of the separation of the cleansed material based upon size.

Another important aspect of this invention is that it can size or classify materials based not their varying densities, but on the varying weights. A homogeneous mixture of a certain substance will have varying sizes of particles involved. Through the selective use of the airflow, the homogenous mixture can be separated based upon weight/size. The airflow entrains the smaller/lighter material and permits the heavier/larger material to fall as described before.

In this manner, a group of separator mechanisms can be used to classsify a clean/ uncontaminated mixture without the use of shaker screens or other such devices. This latter use of the invention is particularly useful in facilities that produce the source material and want to size or classify it for sale The invention, together with various embodiments thereof will be more fully explained by the following drawings and their accompanying descriptions.

DRAWINGS IN BRIEF

Figure 3A:
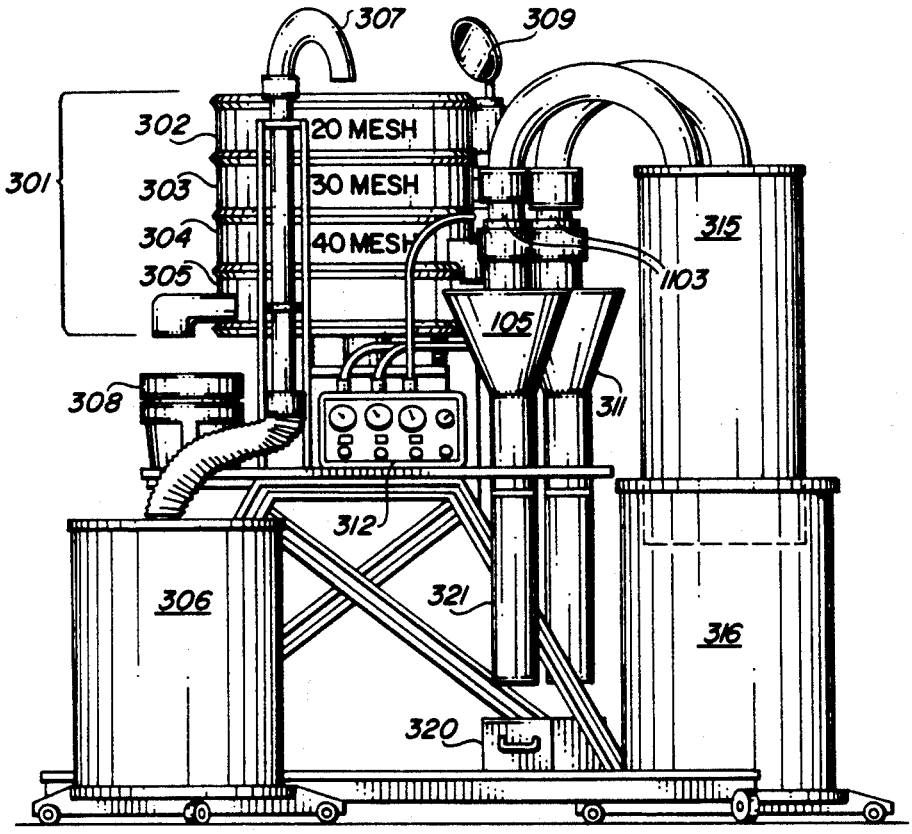
Figure 3B:
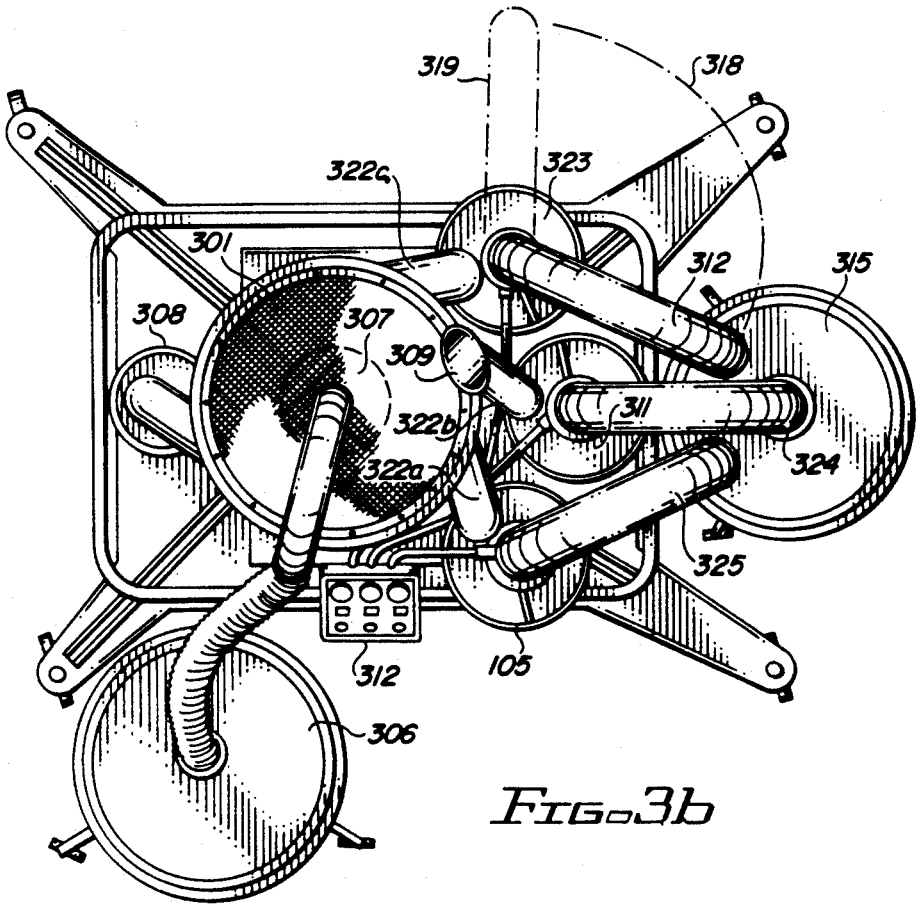

FIG. 3*a* and 3*b* are side and top views of an embodiment of the invention where three seperator tubes are utilized.

Figure 4:
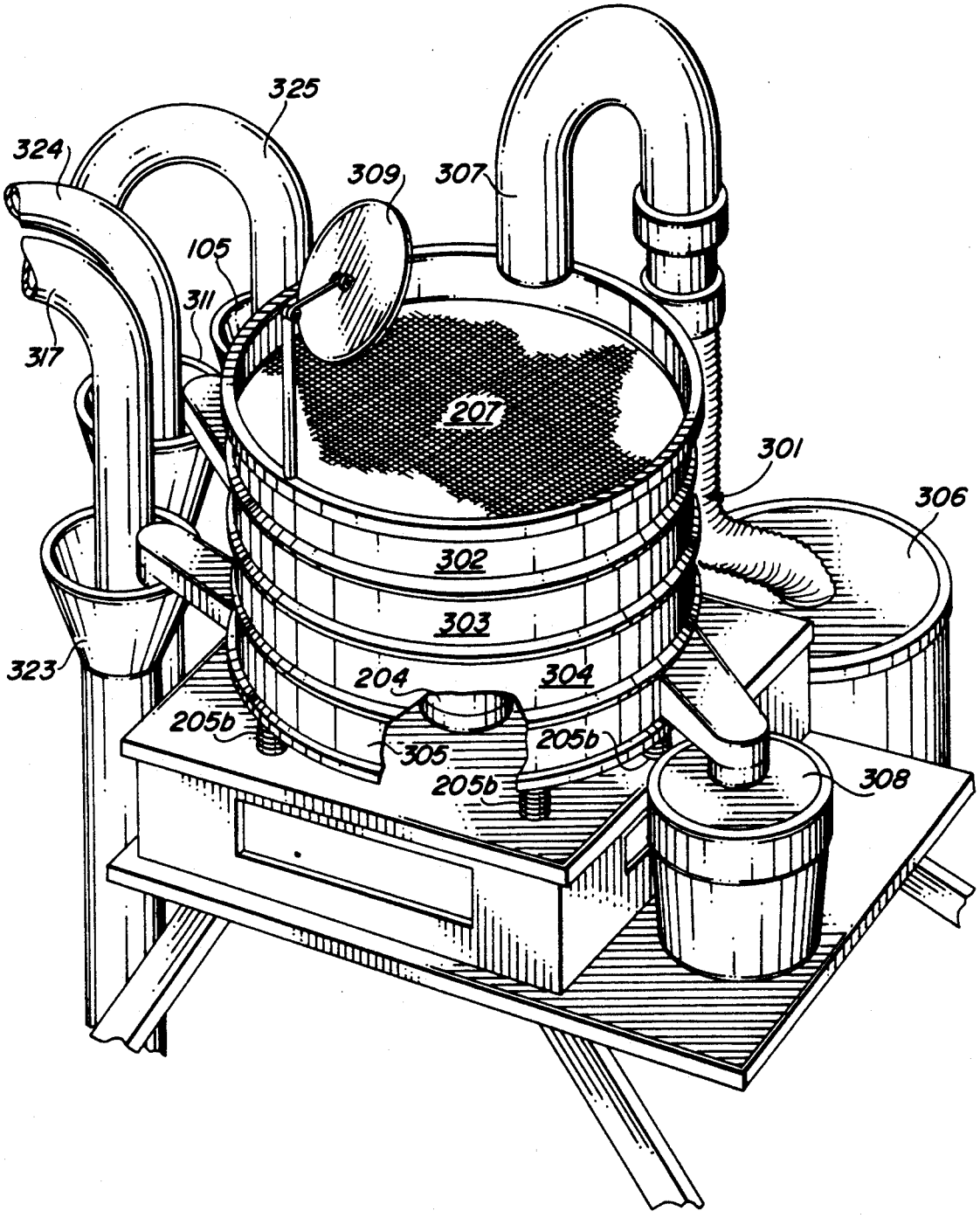

FIG. 4 is a perspective view of an embodiment of the invention illustrating the shaker mechanism.

Figure 5:
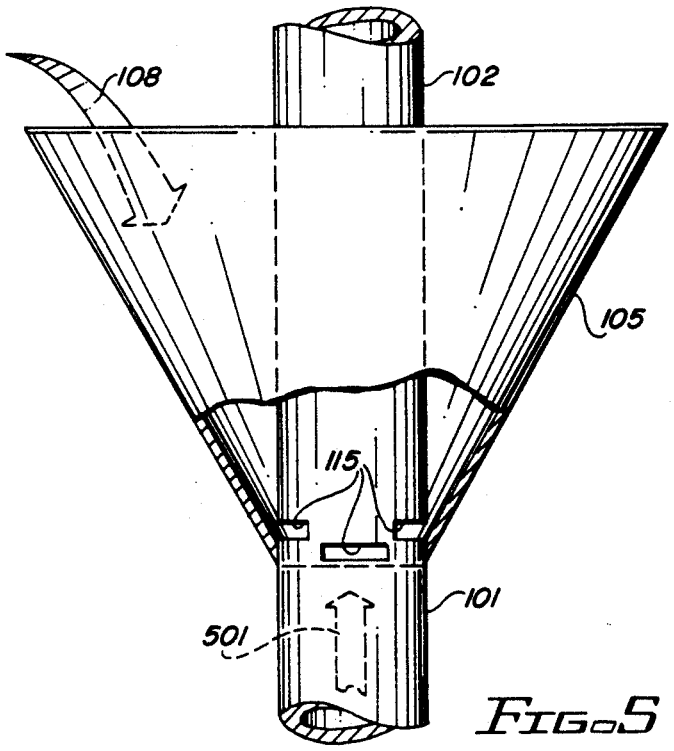

FIG. 5 is a cross sectional view of the preferred embodiment of the mechanism used to deposit the contaminated mixture within the air channel for washing.

Figure 6:
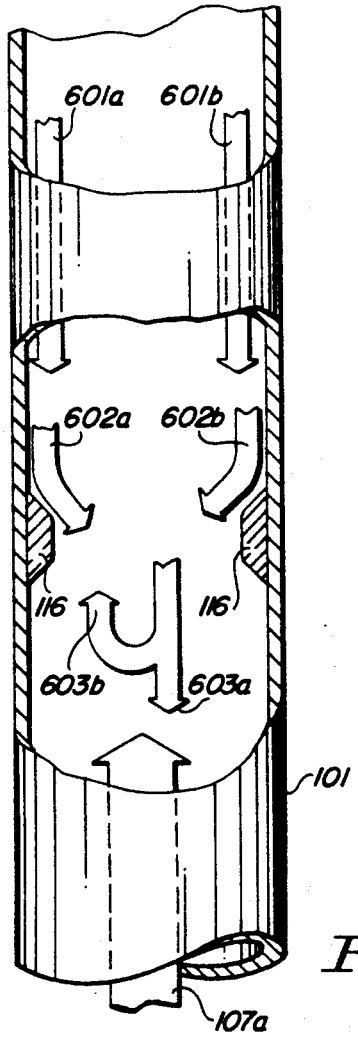

FIG. 6 is a cross sectional view of the preferred embodiment illustrating the final washing deflection mechanism.

DRAWINGS IN DETAIL

Figure 1:
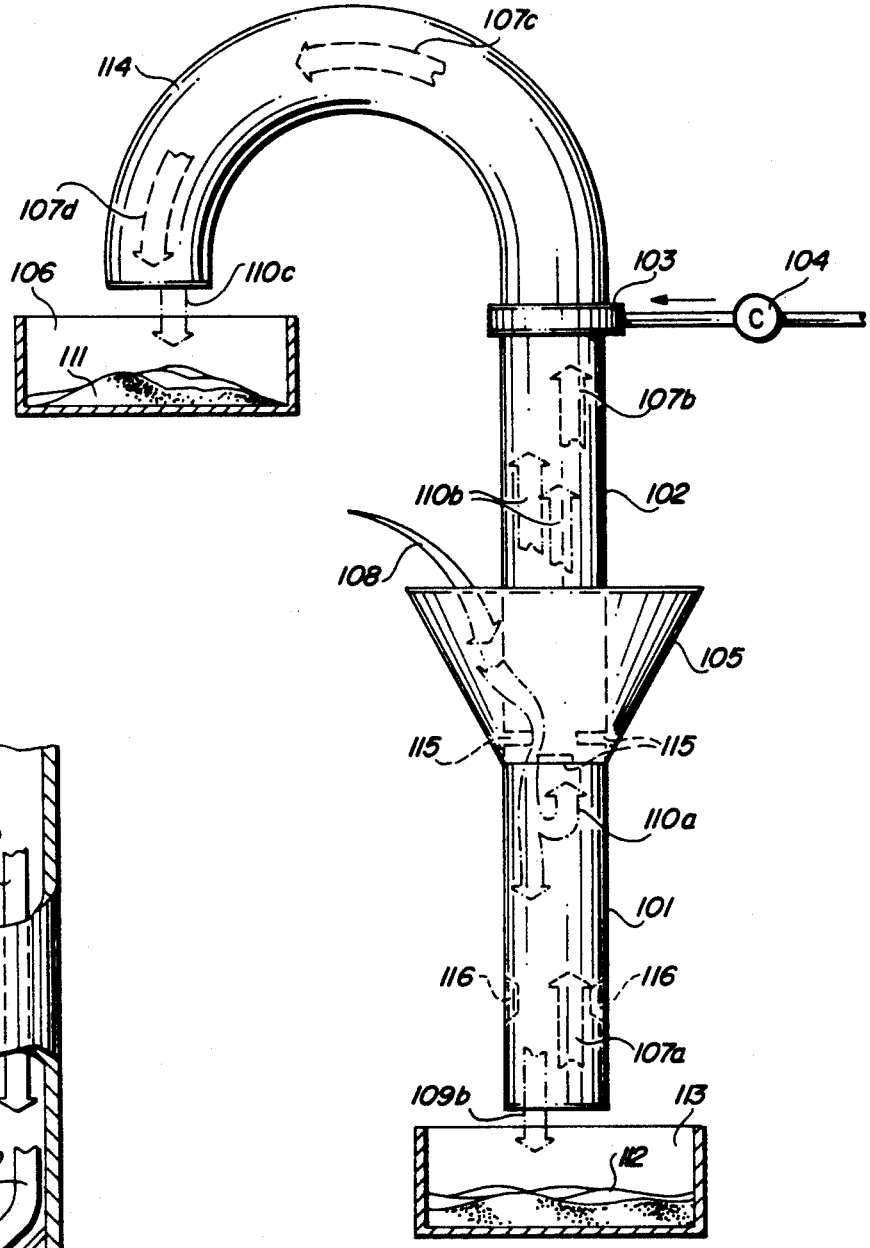
FIG. 1 is a flow diagram illustrating the operation of an embodiment of the invention.

FIG. 1 is a flow diagram of an embodiment of the invention. In this embodiment, the air flow amplifier 103 is supplied a high pressure source of air by compressor 104. The amplifier 103 creates an air flow within air channel 101, 102 and 114, as illustrated by arrows 107*a*, 107*b*, 107*c*, and 107*d*.

The contaminated mixture is placed in the nixing mechanism 105 as illustrated by arrow 108. The contaminated mixture drops into air channel 101 via orfices 115. As the contaminated mixture falls within air channel 101, it separates into the lighter density particles, 110*a*, which are entrained by air flow 107*a*, and the heavier density particles, 109*a*, which resist air flow 107*a*.

The heavier or higher density particles fall as illustrated by arrows 109*a* and 109*b* into container 113 and create a pile 112 therein. If it is the heavier particles which are wanted, then this material, 112, has been cleaned and can be used for its intended application; if it is the lighter or less dense material that is desired, then the particles in container 113, will be disposed using accepted methods.

The lighter or less dense material that has been entrained into the air flow 107*a*, is carried upward as illustrated by arrows 110*a*, and 110*b* and 110*c* by air flow 107*b*, 107*c*, and 107*d*. Air channel 114 directs the lighter particles 110*c* to fall into container 106, for later use or disposal. Particles 111, within container 106, in the case of plastic media separation, are the lighter/ less dense plastic particles and have been "cleaned" for use in a plastic media blasting application.

Figure 2:
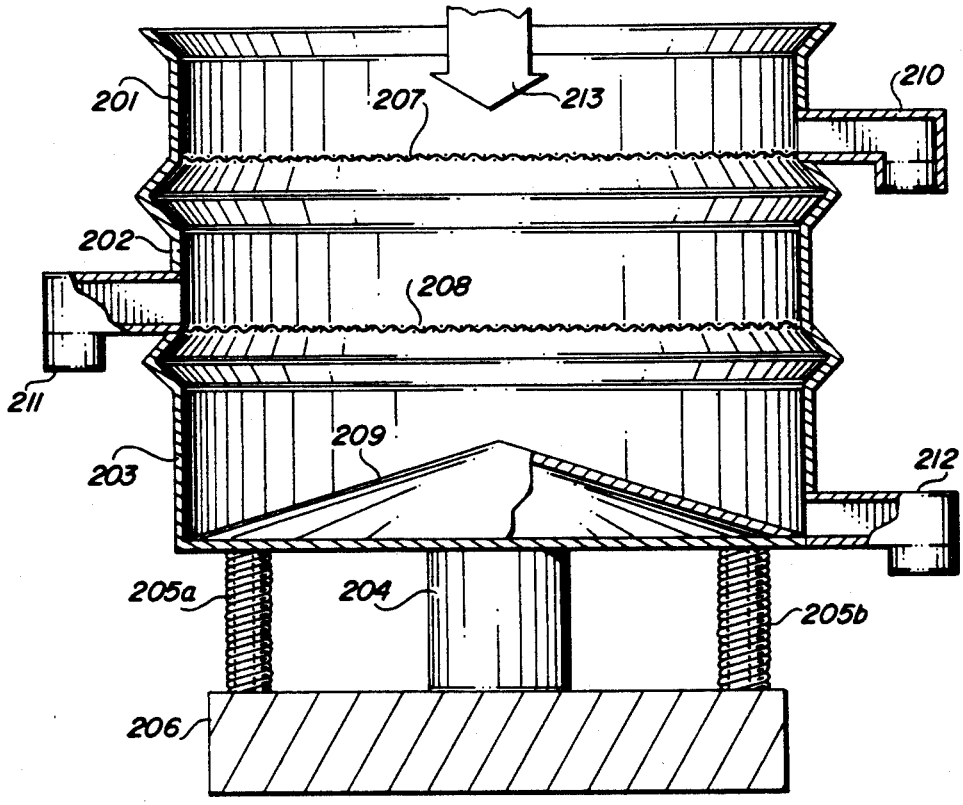
FIG. 2 is a cut-away view of a shaker screen assembly as used in an embodiment of the invention.

An embodiment of the separator screen is illustrated in FIG. 2. The shaker screen assembly is composed of three chambers 201, 202, and 203. The contaminated mixture is introduced into the assembly by depositing it into the top of container 201 as illustrated by arrow 213.

The entire assembly of containers 201, 202, and 203, is vibrated by vibrator 204 and spring mechanisms 205*a* and 205*b*.

The un-sized material falls onto screen 207 within the container 201. Container 201, and therefore screen 207, is vibrated to encourage the material to pass through screen 207. Screen 207 may be of any size but in the preferred embodiment, it has a mesh size of 20.

Particles which are able to pass through screen 207, fall onto screen 208 within container 202. Particles which cannot pass through screen 207, fall through skimmer 210 and are collected. In the preferred embodiment, the particles passing through skimmer 210 are assumed to have a size greater than 20 mesh.

A similar operation occurs within container 202 where screen 208 has a preferred mesh size of 30. Due to the vibration, particles which can pass through the screen 208 do so and fall onto tray 209. The particles which cannot pass through screen 208, fall through skimmer 211 and are collected. In the preferred embodiment of the invention, particles passing through skimmer 211 have a size of between 20 and 30 mesh.

The particles which pass through to container 203 are the smallest of the particles and are forced by tray 209 to pass through skimmer 212. These smallest of particles are so fine that they are typically not of commercial use and are usually disposed.

The entire assembly is attached to base 206 which maintains the shaker in a fixed location during operation.

FIGS. 3*a* and 3*b* are side and top views respectively of an embodiment of the invention where three particle sizers are used. This embodiment is particularly useful in a plastic media cleaning operation.

The contaminated media is placed within drum 306. This dirty media is pushed by an air flow amplifier (not shown) up tube 307 until it drops into the top of shaker assembly 301. Mirror 309 permits the operator to view into the top of shaker assembly 301 to make sure that the dirty media is being supplied at the proper rate.

Shaker assembly 301 contains three screen assemblies which successively size the material with a 20 mesh screen, 302, a 30 mesh screen, 303, and a 40 mesh screen 304. Container 305 of the shaker assembly deposits the very fine waste material into container 308 for later disposal.

In one embodiment of this invention, the medium is first processed through a cyclone seperator before it is placed in the dirty medium drum 306. The cyclone seperator is useful for the removal of plastic fines, paint particles and dust.

Each of the different screens of shaker assembly deposit the now sized, but contaminated mixture, into a dropping mechanism. As example, the particles exiting screen assembly 304 are deposited into dropping mechanism 105; particles from screen assembly 303 are deposited into dropping assembly 105.

Each of the separators operate in similar manner. Controls 312 supply a high pressure air flow to the air flow amplifiers 103. Because each size group has a different weight due to the densities of the particles involved, the pressure supplied to each air flow amplifier may be different to accommodate the varying weights. Changes in the high pressure source to the air flow amplifiers 103 also changes the air flow within the separators.

As illustration, the 30–40 mesh particles that are skimmed from screen 304 are deposited into the dropping mechanism 105. The dropping mechanism 105 permits the particles to fall into the air channel 321 via orfices (not shown). The air flow within air channel 321, as created by air amplifier 103, and dictated by controller 312, is sufficient to entrain the lighter weight or less dense plastic media but is weak enough to permit the heavier contaminates to fall into container 320 for later disposal.

The entrained plastic media is pushed upward and into bag 315. Bag 315 is used in this embodiment to remix the now clean, size separated mixture for later use. The mixed clean media is collected by container 316.

FIG. 3*b* is a top view of the embodiment of the invention described by FIG. 3*a*.

As described earlier, the dirty media is stored in container 306 until it is pushed into the shaker assembly 301 through by pipe 307. Mirror 309 permits the operator to monitor the level of medium being processed by the shaker assembly 301.

Shaker assembly 301 utilizes skimmers 322*a*, 322*b*, and 322*c* to deposit the sized but contaminated mixtures into dropping mechanism 105, 311, and 323 respectively. The cleaned and sized mixture is conveyed through pipes 317, 324, and 325, into bag 315 for remixing and subsequent deposit into clean medium container 316 (not shown in this view).

If a particular size of medium is not desired to be re-mixxed, pipe 317 can be swiveled as illustrated by arrow 318 into position 319 for depositing the sized, clean medium into another container. In this manner, the medium can be separated according to size if so desired.

FIG. 4 is a perspective view of an embodiment of the invention. This view illustrates the use of the shaker or separator 301. Shaker mechanism 301 has four different principal sections 302, 303, 304, and 305 which contain screens for the sizing of the particle mixture deposited by pipe 307.

Each of the principal sections of shaker 301 deposits its sized particles into a separator mechanism. As example, the largest size is obtained by screen section 302 which deposits its mixture into the depositing mechanism 311 via exit port 602. In a similar manner, exit port 601 removes the next size from shaker mechanism 303 and places the mixture into depositing mechanism 310.

In this manner, each separator mechanism is supplied with a contaiminated mixture having a general range of size (i.e. 20-30 mesh) and is adjusted to handle that size.

FIG. 5 is a cross sectional view of the preferred embodiment of the invention and illustrates the use of the slots to form a sheet of contaminated mixture entering the air channel.

The contaminated mixture is dumped into the mechanism 105 as illustrated by arrow 108. The mixture collects at the bottom of the depositing mechanism 105 and falls through slots 115 into the air channel 101.

Because the mixture falls through a slot, it naturally falls in a sheet as opposed to a stream. The sheet of mixture is easily separated into a lighter group of particles (which rise) and the heavier particles (which fall) by air flow 501.

The actual width of slots 115 vary according to the particle sizes in question and the ability to feed the mixture through the slots. The narrower the slots are, the thinner the sheet of contaminated mixture will be and thus the cleaning procedure will be more efficient. The efficiency of the cleaning procedure must be balanced against the throughput desired by the mechanism.

FIG. 6 illustrates an embodiment of the final wash or deflection mechanism. Through experimentation, it has been determined that due to the boundary layer affect, the airflow next to the walls of air channel 101 is less than that in the center. Since the airflow near the wall is slower, it is incapable of entraining the lighter material and permits it to fail with the heavier material as illustrated by arrows 601*a* and 601*b*.

To cure this, a deflection ring 116 is placed around the interior circumferance of the air channel 101. The deflection ring 116 forces the falling mixture away from the wall, as illustrated by arrows 602*a* and 602*b*, and toward the center of the air channel 101 so that the appropriate air flow 107*a* can perform a final wash of the contaminated mixture. This final wash separates and entrains the lighter particles, illustrated by arrow 603*b*, while permitting the heavier particles to continue to fall, illustrated by arrow 603*a*.

It is clear from the foregoing that the present invention represents a new and useful device for the efficient and inexpensive separation of particles based upon their relative weights.

What is claimed is:

1. A mechanism for the separation of particle shaving a first weight from particles having a heavier second weight, the mechanism comprising:

a) a first gas channel having a first end and a second end, said first gas channel being disposed such that the first end is positioned directly above the second end;

b) a second gas channel having a first end and a second end, said second end disposed above said first end;

c) a gas flow amplifier attached to the first end of said first gas channel, said gas flow amplifier directing a gas flow into the second gas channel via the first end thereof, thereby drawing ambient gases through said second end of said first gas channel and establishing a gas flow in said second gas channel composed of ambient gas via the first gas channel and gases from said gas flow amplifier; and, d) means for depositing a mixture of said first particles and said second particles into said first gas channel at a point below said gas flow amplifier.

2. The mechanism according to claim 1 further comprising means for washing any mixture falling along the walls of said first gas channel.

3. The mechanism according to claim 2 wherein said means for washing includes a deflection ring.

4. The mechanism according to claim 3 wherein said means for depositing includes means for depositing said mixture in a sheet.

5. The mechanism according to claim 4 further comprising gas compression means for supplying a compressed gas flow to said gas flow amplifier.

6. The mechanism according to claim 5 further comprising control means for control of the gas pressure being delivered from said gas compression means to said gas flow amplifier and wherein said control means has an operator selective means to establish an amplified gas flow.

7. The mechanism according to claim 6 wherein said control means includes preselected gas pressure control for selective separation of particles according to weight.

8. The mechanism according to claim 7 further comprising means for sizing for establishing that said first particle and said second particle are approximately the same size, and wherein said means for sizing operates on said mixture prior to said mixture being deposited into said first gas channel.

9. The mechanism according to claim 8 wherein said means for sizing includes a shaker screen.

10. The mechanism according to claim 9 further comprising means for moving the mixture from said means for sizing to said means for depositing.

11. The mechanism according to claim 9 further comprising:

a) a first container for storage of said mixture;

b) a second means for moving said mixture from said first container to said means for sizing;

c) a second container positioned at the second end of said first gas channel for receipt of said second particles; and, d) a third container positioned at the second end of said second gas channel for receipt of said first particles.

12. A system for the separation of particles based upon weight and size comprising:

a) container means for holding said mixture of particles;

b) means for sizing said mixture into N sized-mixtures where the particles within each sized-mixture have comparable sizes, and where N is an integer greater than 1; and, c) N particle separators, each particle separator operating on a selected one of said sized-mixtures and wherein each of said particle separators has, 1) a first gas channel having a first end and a second end, said first gas channel being disposed such that the first end is positioned directly above the second end, 2) a second gas channel having a first end and a second end, said second end disposed above said first end, 3) a gas flow amplifier attached to the first end of said first gas channel, said gas flow amplifier directing a gas flow into the second gas channel via the first end thereof, thereby drawing ambient gases through said second end of said first gas channel and establishing a gas flow in said second gas channel composed of ambient gas via the first gas channel and gases from said gas flow amplifier, and, 4) means for depositing a mixture of said first particles and said second particles into said first gas channel at a point below said gas flow amplifier.

13. The system according to claim 12 further comprising N means for washing, each of said means for washing located in one of said first gas channels.

14. The system according to claim 13 wherein each of said N means for washing includes a means for deflecting any mixture dropping along the wall of a gas channel towards the center of the gas channel.

15. The system according to claim 13 wherein said means for depositing includes means for depositing said sized-mixture in a sheet.

16. The system according to claim 15 further comprising gas compression means for supplying a compressed gas flow to each of said gas flow amplifiers.

17. The system according to claim 16 further comprising control means for control of the gas pressure being delivered from said gas compression means to each of said gas flow amplifiers and wherein said control means has an operator selective means to establish a specified amplified gas flow within each of said first gas channels.

18. The system according to claim 17 wherein said means for sizing includes a shaker screen assembly having N selected mesh sizes.

19. The system according to claim 18 further comprising means for removing large particles from said mixture which do not pass through said shaker screen assembly.

20. The system according to claim 17 further comprising N means for moving the mixture from said means for sizing to said means for depositing.

* * * * *